US010032571B2

(12) United States Patent
Olson et al.

(10) Patent No.: US 10,032,571 B2
(45) Date of Patent: Jul. 24, 2018

(54) IN-LINE BYPASS SWITCH

(71) Applicant: Kinetech LLC, Indianapolis, IN (US)

(72) Inventors: Mark Olson, Indianapolis, IN (US); Todd Utley, Anderson, IN (US)

(73) Assignee: Kinetech LLC, Indianapolis, IN (US)

( * ) Notice: Subject to any disclaimer, the term of this patent is extended or adjusted under 35 U.S.C. 154(b) by 0 days.

(21) Appl. No.: 15/250,456

(22) Filed: Aug. 29, 2016

(65) Prior Publication Data

US 2016/0365201 A1 Dec. 15, 2016

Related U.S. Application Data

(63) Continuation of application No. 14/603,040, filed on Jan. 22, 2015, now Pat. No. 9,509,065.

(60) Provisional application No. 61/930,506, filed on Jan. 23, 2014.

(51) Int. Cl.

| | |
|---|---|
| ***H01H 9/02*** | (2006.01) |
| ***H01R 4/2404*** | (2018.01) |
| ***H01R 13/50*** | (2006.01) |
| ***H01H 15/24*** | (2006.01) |
| ***H01R 13/707*** | (2006.01) |
| *H01H 15/02* | (2006.01) |

(52) U.S. Cl.

CPC ..... *H01H 9/0228* (2013.01); *H01H 15/24* (2013.01); *H01R 4/2404* (2013.01); *H01R 13/501* (2013.01); *H01R 13/707* (2013.01); *H01H 9/02* (2013.01); *H01H 15/02* (2013.01); *H01H 2300/056* (2013.01); *H01R 2201/26* (2013.01)

(58) Field of Classification Search

CPC ..... H01R 4/24; H01R 4/2404; H01R 4/2416; H01R 4/242; H01R 4/2429; H01R 4/2433; H01R 12/67; H01R 12/675; H01H 1/585; H01H 9/0288

USPC ..... 200/51 R, 275, 284, 298; 439/389, 391, 439/393, 395–398, 400, 404–406, 439/408–410

See application file for complete search history.

(56) References Cited

U.S. PATENT DOCUMENTS

| | | | | |
|---|---|---|---|---|
| 4,549,116 | A | 10/1985 | Andrews | |
| 4,612,423 | A * | 9/1986 | Munroe | H01H 1/585 200/16 R |
| 4,822,297 | A | 4/1989 | Prince | |
| 5,059,137 | A | 10/1991 | Dale | |
| 5,399,098 | A | 3/1995 | Marshall | |

(Continued)

*Primary Examiner* — Vanessa Girardi

(74) *Attorney, Agent, or Firm* — Maginot, Moore & Beck LLP

(57) ABSTRACT

A device configured for installation on a wire includes a housing with a wire passage provided therein. A blade is configured to extend through the wire passage and sever the wire. A first electrically conductive member is configured to extend into the wire passage and engage a first end of the severed wire, and a second electrically conductive member is configured to extend into the wire passage and engage a second end of the severed wire. The first end of the severed wire is connected to the second end of the severed wire when a switch arrangement is in a closed position. The first end of the severed wire is disconnected from the second end of the severed wire when the switch arrangement is in an open position. A manual actuator is configured to move the switch arrangement between the open position and the closed position.

20 Claims, 7 Drawing Sheets

(56) References Cited

U.S. PATENT DOCUMENTS

| | | | |
|---|---|---|---|
| 6,988,909 | B2 | 1/2006 | Morizaki |
| 7,922,541 | B2 | 4/2011 | Maenhout |

* cited by examiner

IN-LINE BYPASS SWITCH

CROSS-REFERENCE TO RELATED APPLICATIONS

This application is a continuation of U.S. patent application Ser. No. 14/603,040, filed Jan. 22, 2015, which claims priority from U.S. provisional patent application No. 61/930,506, filed Jan. 23, 2014, the entire contents of which are incorporated herein by reference.

FIELD

This document relates to the field of electronic wiring devices, and particularly to devices designed to facilitate installation of additional components into existing circuits.

BACKGROUND

Electronic wiring and circuitry is ubiquitous in the modern world. Many goods sold to the modern consumer incorporate various electronic devices and subsystems along with associated electric wiring and circuitry. These goods may be relatively large devices designed to remain stationary relative to a base, or relatively small devices designed to be carried by a user. Examples of such goods include homes and automobiles which may both include lighting, automation, and environmental control systems, as well as numerous other devices such as kitchen appliances, video systems, phones, watches, etc.

With many goods that incorporate electronic devices, the consumer may wish to modify the existing electronics in the device to add additional capabilities. For example, the owner of a home may wish to install an alarm and other security devices that are powered by existing circuitry in the home. As another example, owners of automobiles often wish to customize their automobile by adding aftermarket components such as custom stereo or lighting systems. When this is the case, the consumer or a hired technician will typically be required to cut existing wiring or other electrical connections in order to install the new electronic devices.

The process of cutting and re-wiring in order to add additional electronic components in homes, automobiles, or other systems is not only time consuming, but is also prone to error. Moreover, if the consumer decides that he or she does not like the newly added functionality provided by a previously installed aftermarket component and decides to remove the component, it is often difficult to restore the wiring system to its original condition. Accordingly, it would be advantageous to provide a device that would allow a user to easily modify an existing wiring arrangement for an electronic system in order to add an additional electronic component to the system. It would also be advantageous if such a device were relatively inexpensive and easy to install. Additionally, it would be advantageous if such a device allowed the user to easily remove the installed component and return the wiring arrangement to its original configuration.

SUMMARY

In at least one embodiment, a device is configured for installation on a wire. The device includes a housing comprising a first portion and a second portion. A wire passage is provided in the housing and configured to retain the wire. A blade is configured to extend through the wire passage and sever the wire when the wire is positioned in the wire passage. A first electrically conductive member is configured to extend into the wire passage and engage a first end of the severed wire, and a second electrically conductive member is configured to extend into the wire passage and engage a second end of the severed wire. A switch arrangement is also retained by the housing. The first end of the severed wire is connected to the second end of the severed wire when the switch arrangement is in a closed position. The first end of the severed wire is disconnected from the second end of the severed wire when the switch arrangement is in an open position. A manual actuator is configured to move the switch arrangement between the open position and the closed position.

In at least one alternative embodiment, a device is configured for installation on a wire. The device includes a housing with a wire passage provided in the housing. A blade is positioned in the housing and configured to extend substantially through the wire passage, the blade dividing the wire passage into a first portion and a second portion. A first electrically conductive member is positioned in the housing and configured to extend into the first portion of the wire passage. A second electrically conductive member positioned in the housing and configured to extend into the second portion of the wire passage. A switch arrangement is retained by the housing. The switch arrangement includes an electrical pathway extending between the first electrically conductive member and the second electrically conductive member. The switch arrangement is moveable between a closed position and an open position, wherein the electrical pathway is closed when the switch arrangement is in the closed position, and wherein the electrical pathway is open when the switch arrangement is in the open position. A manual actuator configured to move the switch arrangement between the open position and the closed position.

A method of coupling an electronic module to an existing circuit is disclosed. The method comprises coupling a housing with a switching arrangement to a wire of the existing circuit, the switching arrangement including a manual actuator. The method further includes severing the wire into a first end positioned within the housing and a second end positioned within the housing, the first end connected to a first terminal retained by the housing and the second end connected to a second terminal retained by the housing with an electrical pathway extending between the first terminal and the second terminal. Leads of the electronic module are connected to the first terminal and the second terminal, the electronic module separate from the housing. The method further includes moving the manual actuator of the switching arrangement from a first position to a second position such that the electrical pathway is opened between the first terminal and the second terminal.

The above described features and advantages, as well as others, will become more readily apparent to those of ordinary skill in the art by reference to the following detailed description and accompanying drawings. While it would be desirable to provide an adaptive shunt for a pulsating brake light that provides one or more of these or other advantageous features, the teachings disclosed herein extend to those embodiments which fall within the scope of the appended claims, regardless of whether they accomplish one or more of the above-mentioned advantages.

DESCRIPTION

A wire cut and tap device 10, as described herein, is designed to cut into and tap an existing wire in an electrical system in a relatively quick and non-invasive manner. For example, the device may be used to cut into and tap a wire in an existing vehicle wiring system. The device, once installed, allows the user to make high quality professional connections to a wiring harness without compromising the integrity of the wiring system. The device (which may also be referred to herein as a "switch arrangement device" or a "wire cut and tap with bypass feature") allows the user to add electronic modules and other electronic accessories to the wiring system (e.g., a vehicle wiring system). These accessories may be removed later without leaving the wiring harness compromised. Furthermore, the device is designed to quickly and easily restore the vehicle wire circuits to stock condition upon the simple flip, transition or other manual actuation of a switching arrangement.

First Exemplary Embodiment

Figure 1:
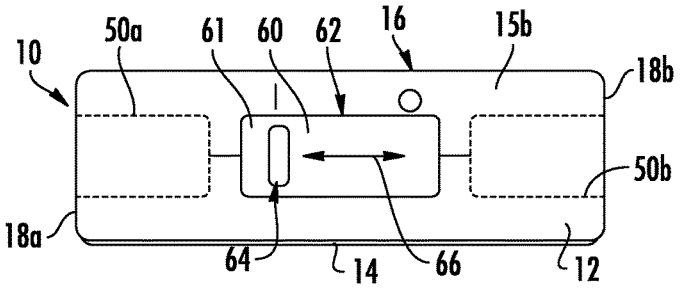
FIG. 1 shows a bottom view of a wire cut and tap device including connector slots at opposite ends of the device housing.
Figure 2:
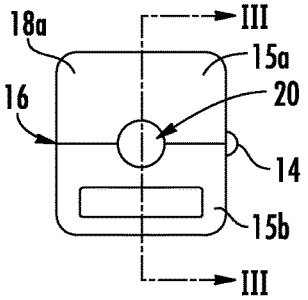
FIG. 2 shows an end view of the wire cut and tap device of FIG. 1.

With particular reference to FIGS. 1 and 2, the device 10 includes a housing 12 comprised of a relatively rigid plastic material. The housing 12 is designed in a clamshell fashion with a living hinge 14 coupling two halves 15*a* and 15*b* of the housing 12. Two snapping clasps (not shown in FIG. 1; see exemplary clasps 24 in FIGS. 5-8) are provided along a seam/mouth 16 opposite the living hinge 14. The snapping clasps are configured to maintain the housing in a closed and locked position. The housing 12 provides a protective shell for the conductors and electronic components positioned within the housing 12. A wire passage 20 is formed in the housing 12 from a first end to a second end of the device 10.

The wire passage 20 is generally cylindrical in shape and is configured to receive a wire (of a maximum wire gauge) and allow it to extend completely through the device 10 from a first end 18*a* to a second end 18*b*. When the mouth 16 is open, the wire passage 20 is provided as an open half-cylinder extending through the interior of each half of the housing 12. An existing wire/conductor 22 of an electrical circuit may be placed in the open mouth 16 of the housing 12 and situated in the wire passage 20. The mouth 16 may then be closed to trap the wire 22 in place within the housing 12.

Figure 3:
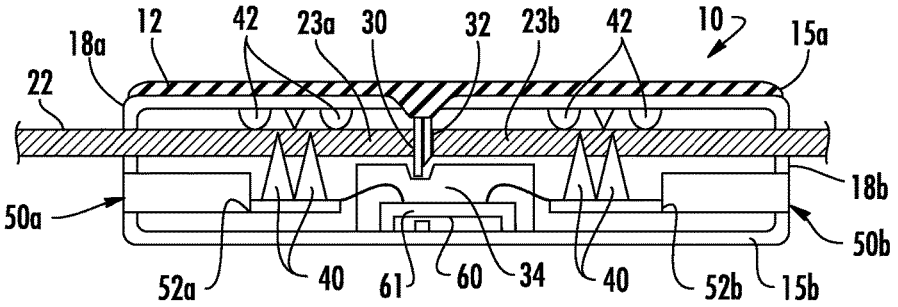
FIG. 3 shows a cross-sectional view of the wire cut and tap device of FIG. 1 with an existing wire of an electrical system extending through the wire cut and tap device.

With reference now to FIG. 3, when the mouth 16 of the housing 12 is closed around a conductor, the two sides of the housing 12 are moved into matching alignment with the first half 15*a* of the housing 12 closed on the second half 15*b* of the housing 12. With the first half 15*a* closed on the second half 15*b* of the housing, the complete wire passage 20 is formed around the conductor (i.e., the wire passage 20 completely surrounds the conductor) and the two snapping clasps hold the two halves 15*a* and 15*b* of the housing 12 together. If a user finds it difficult to completely close the housing 12 around the conductor 22, a hand tool such as pliers or a small portable vice or press may be used to bring the two snapping clasps into locking engagement.

With continued reference to FIG. 3, the inner portion of the housing 12 securely retains a cutting blade 30 with a non-conductive material 32 provided on one side of the blade 30. The cutting blade 30 is generally flat and thin with a sharp tip designed to cut through wire. The cutting blade 30 is sufficiently long and sufficiently wide to cut completely through the conductor for which the device 10 is designed for use (e.g., the cutting blade 30 may be 2-10 mm greater in width and extend 2-10 mm past the wire passage 20 which is configured to receive the conductor). The blade 30 may be provided by any of various materials with a sufficient hardness (e.g., a sufficient durometer) to provide a useful blade. The material used for the blade 30 may depend, in part, on the gauge of the wire the device is designed to cut. In at least one embodiment, the blade 30 may be an electrically conductive material, such as steel, or a relatively non-electrically conductive material such as graphite. In at least one alternative embodiment of the device, and particularly and embodiment for smaller gauge wire, the blade 30 is molded from the same material as the housing as an integrated component of the housing 12.

The electrically non-conductive material may be provided by a material that has a sufficient insulation factor and thickness to block the flow of electricity in an appropriately rated circuit. In at least one embodiment, the non-conductive material 32 is a nonconductive epoxy of phenolic plastic or a ceramic coating. The non-conductive material is provided as a relatively thin layer on the blade 30 so as not to interfere with the cutting action of the blade 30. In the embodiment disclosed herein, the non-conductive material 32 is provided as a layer that covers an entire side of the blade 30. In at least one alternative embodiment, the non-conductive material may be provided as two different layers that sandwich the blade 30, leaving the sharp tip of the blade exposed.

With continued reference to FIG. 3, when the two halves 15*a* and 15*b* of the housing 12 are pressed together over the conductor 22, the blade 30 cuts the conductor 22 in two at the center of the housing 12. Once fully compressed the blade 30 extends completely through the wire passage 20 such that the conductor 22 is completely severed by the blade 30, and the blade 30 engages a resilient cutting block 34 in the lower half 15*b* of the housing 12. The non-conductive material 32 and the blade 30 remain between and completely separate the two severed ends 23*a* and 23*b* of the conductor 22. Because material 32 is non-conductive, electricity is blocked from flowing between the two ends 23*a* and 23*b* of the severed conductor. Simultaneously, as the two halves 15*a* and 15*b* of the housing 12 are pressed together, the two ends of the severed conductors ends 23*a* and 23*b* each penetrated by electrically conductive protrusions 40 which are electrically coupled to two terminals 52*a*, 52*b*. The two terminals 52*a* and 52*b* are encased in the bottom of the housing 12 in parallel with the conductor 22.

The electrically conductive protrusions 40 are provided as sharp metal prongs in the embodiment of FIGS. 1-3, but may also be provided in a number of different configurations, shapes and sizes. In the embodiment of FIG. 3, the metal protrusions 40 have a generally triangular cross-sectional shape with an apex that is configured to rest within the wire passage 20 when the two halves 15*a* and 15*b* of the housing are pressed together. As a result the apex of the protrusions 40 are embedded securely within any wire that extends through the wire passage 20. In the embodiment of FIG. 3, the protrusions 40 include two pairs of protrusions mounted on an electrically conductive plate on the lower half 15*b* of the housing. Each pair of protrusions 40 and the plates on which they are mounted are associated with and electrically connected to one of two terminals 52*a* and 52*b*.

The internal portion of the housing 12 also includes gripping teeth 42 molded into the plastic shell interior that assist in retaining the severed conductor ends 23*a* and 23*b* securely in place. The gripping teeth 42 are comprised of a generally non-conductive and relatively resilient material such as a TPU or other elastomer. The gripping teeth 42 may be blunt or sharp, but the resilient material used to form the gripping teeth 42 provides a surface with a high coefficient of friction, and this surface engages the insulator surrounding the wire 22 and retains the wire 22 in place within the wire passage 20.

As noted previously, the two terminals 52*a* and 52*b* provide an electrical connection path to the sharp metal protrusions 40. In at least one embodiment, the terminals 52*a* and 52*b* are female spade terminals positioned in connector slots 50*a* and 50*b* on either end 18*a*, 18*b* of the clam shell housing 12. These slots 50*a* and 50*b* allow a lead with a connector attached thereto, such as a male spade terminal, to be press fit into the plastic housing 18 and connect to the female spade terminals 52*a*, 52*b*. In at least one embodiment, the male spade terminal may simply be the end of a relatively rigid conductor wire providing the lead to the device 10. If the male spade terminals are connected to an electronic component accessory (as described in further detail below), first electrical path is provided to the first severed end 23*a* of the wire 22 by the first terminal 52*a*, and a second electrical path is provided to the second severed end 23*b* of the wire 22 by the second terminal 52*b*. Electrical current may then flow from the first severed end 23*a* of the wire 22, through the connected module, and then to the second severed end 23*b* of the wire 22.

With reference now to FIGS. 1 and 3, the wire cut and tap device 10 further includes a switching arrangement 60 that allows the device 10 to be operated in one of two modes. In a first mode, the switching arrangement 60 is open, and an electrical pathway within the housing which is configured to electrically connect the two severed ends 23*a* and 23*b* of the wire 22 is open. As a result, the two severed ends 23*a* and 23*b* remain disconnected with electrical connections to the severed ends 23*a* and 23*b* only provided via the terminals 52*a* and 52*b*. However, in a second mode, the switching arrangement 60 is closed such that the electrical pathway within the housing 12 connects the two severed ends 23*a* and 23*b* of the wire 22. In at least one embodiment, the switching arrangement and the associated electrical pathway are provided by a small single-throw-single-pole slide switch 61. In at least one embodiment, this switch 61 is capable of conducting several amps of current at 14 VDC (e.g., between 2 and 10 amps). In other embodiments, differently rated switches may be appropriate, depending on the type of circuit in which the wire cut and tap device 10 is installed.

As shown in FIGS. 1 and 3, the switch 61 may be positioned in a recess 62 on the exterior of the housing 12. A slot 64 is positioned in the recess 62 to allow a user to insert a small screwdriver or other similar hand tool and toggle the switch between the open and closed positions, as indicated by arrows 66. When the switch 61 is closed, a connection between the conductor ends 23*a* and 23*b* is established within the housing 12 via the switch 60. When the switch 61 is open, there is no connection between the conductor ends 23*a* and 23*b* within the housing 12. Accordingly, when an electrical accessory is attached to the device 10 across the spade terminals 52*a* and 52*b*, the switch 61 should be place in the open position to prevent shorting of the electrical accessory. In the event that the installed accessory should be excluded from across the spade terminals 52*a* and 52*b*, the user simply closes the switch 61 by manually actuating the slide member (as indicated by arrows 66 in FIG. 1), thus closing the switch 61. In other embodiments, the manual actuator may be provided in other forms (other than a slide member), as will be recognized by those of ordinary skill in the art. With the switch 61 closed, a direct connection is established between the terminals 52*a* and 52*b*, thus shorting out any module or other accessory connected across the terminals 52*a* and 52*b*. As a result, when the switch is closed the circuit incorporating wire 22 is restored to the original setting with a connection between severed ends 23*a* and 23*b*. This allows a user to quickly and easily restore a circuit to its original factory setting that existed prior to installation of the wire cut and tap device 10 and any associated accessory device. Even though the wire cut ant tap device 10 remains permanently in place once installed, the user is provided with the option to easily remove the accessory device by the simple flip of a switch. Should the user desire to re-install the accessory item, the switch position can simply be reversed and the spade terminals 52*a* and 52*b* plugged back in.

Second Exemplary Embodiment of Device

Figure 4:
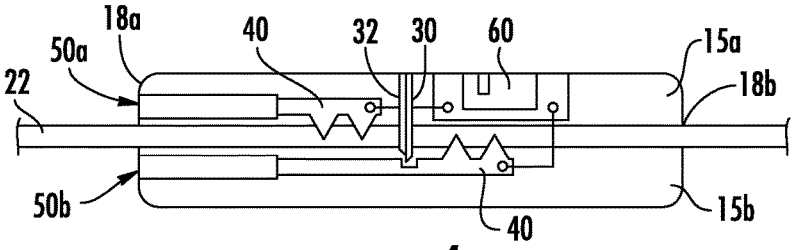
FIG. 4 shows a cross-sectional view of an alternative embodiment of the wire cut and tap device of FIG. 1 with connector slots on the same end of the device housing.
Figure 5:
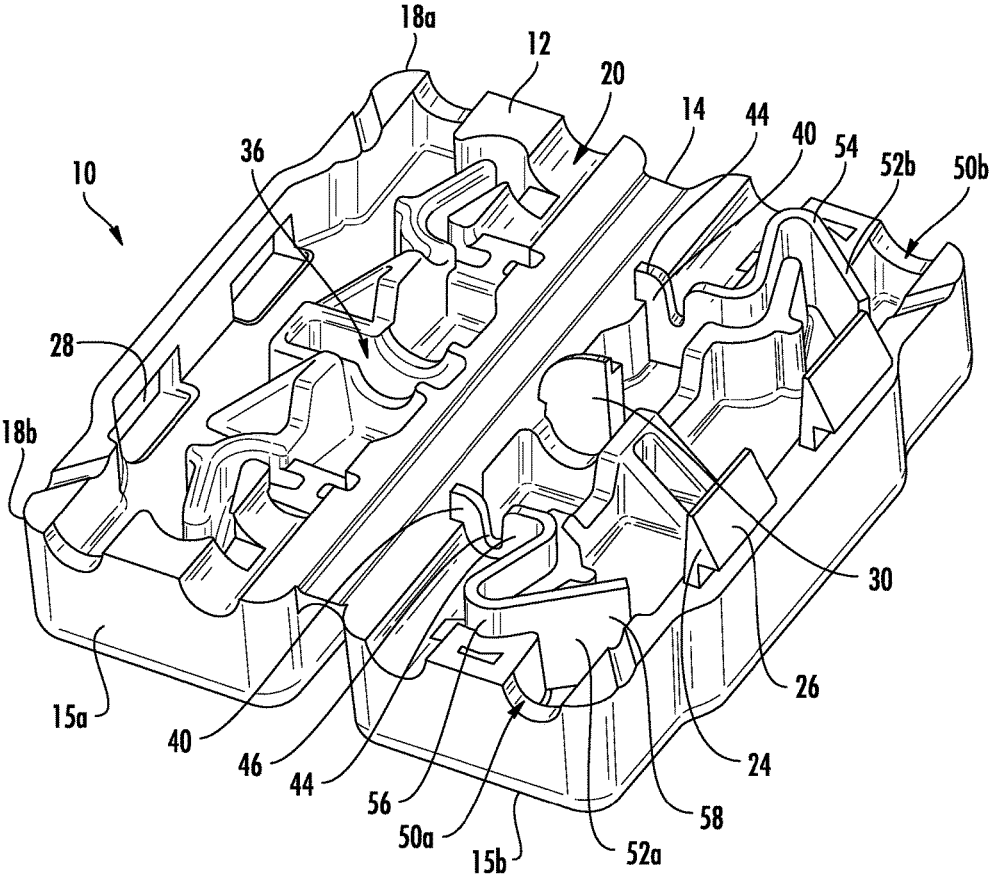
FIG. 5 is a perspective view of another alternative embodiment of the wire cut and tap device of FIG. 1 in an open position.

With reference now to FIG. 4, an alternative embodiment of the wire cut and tap device 10 is shown. The device of FIG. 4 is similar to that of FIGS. 1-3 and like reference numerals are used to show like components. However, significant distinctions also exist. For example, in the embodiment of FIG. 4, both of the slots 50*a*, 50*b*, and associated spade terminals 52*a* and 52*b* are positioned on the same side 18*a* of the housing 12. As a result, the switch 60 is moved closer to the opposite side 18*b* of the housing. Because the spade terminals 52*a* and 52*b* are located on the same side of the housing 12, the leads to the accessory component added to the device may be shorter, resulting in a smaller overall package for the device 10 and accessory component. Also, this arrangement may provide advantages if access to one side of the housing 12 is limited after the device is clipped onto the wire harness.

Third Exemplary Embodiment of the Device

With reference now to FIGS. 5-8, another alternative embodiment of the wire cut and tap device 10 is shown. The device of FIGS. 5-8 is similar to that of FIGS. 1-3 and like reference numerals are used to show like components. However, significant distinctions also exist. For example, in the embodiment of FIGS. 5-8, the housing 12 includes two clasps 24 configured to securely lock the two halves 15*a* and

15*b* of the housing together and retain the housing 12 in a closed position. Each clasp 24 includes a finger with a locking tab 26 provided on one half 15*b* of the housing and recess 28 formed in the other half 15*a* of the housing. When the two halves 15*a* and 15*b* are clamped together the locking tabs 26 engage the recesses 28 in the housing 12 and lock the two halves together. When the two halves 15*a* and 15*b* are locked together, the blade 30 severs any wire extending through the wire passage 20 and the end of the blade 30 extends into an empty chamber 36 in the upper half 15*a* of the housing 12 (instead of engaging the cutting block 34 in the embodiment of FIGS. 1-3).

Another exemplary distinction in the embodiment of FIGS. 5-8 is provided by the protrusions 40, which are plate members 44 rather than prong structures. The plate members 44 are securely embedded within the lower half 15*b* of the housing 12. Each plate member 44 includes a small notch having a relatively sharp surface in the upper perimeter of the plate-like member 44. The notch provides a cradle 46 that is designed and dimensioned to receive the wire in a manner that cuts into the wire but does not sever the wire. In particular, when the housing is closed, the wire in the wire passage 20 is forced into the cradle 46 such that the cradle 46 pierces through any surrounding insulation on the wire. The cradle 46 also cuts into the wire, or otherwise engages the wire, but does not sever the wire. As a result, an electrical connection is established between the protrusion 40 and the associated end of the wire extending through the wire passage 20.

The protrusions 40 are electrically connected to the terminals 52*a* and 52*b*. In the embodiment of FIGS. 5-8, the terminals 52*a* and 52*b* are integrally formed with the protrusions 40 such that each terminal 52*a* or 52*b* and the associated protrusion 40 is provided as a unitary component. These unitary components may be formed in any of various ways such as molding an electrically conductive material, stamping and bending a metal sheet into the desired component shape, welding electrically conductive components together, or any of various other methods as will be recognized by those of ordinary skill in the art.

In the embodiment of FIGS. 5-8, each terminal 52*a* and 52*b* is provided as a spring terminal 54 that includes a moveable arm 58 that is configured to pivot at a bend 56. Each spring terminal 54 is generally retained in place within the housing 12 by various ribs which engage the spring terminal 54 at various locations. One of the ribs is positioned in close proximity to the bend 56, but no ribs are in close proximity to the moveable arm 58. Accordingly, the spring terminal 54 is arranged in the housing 12 to allow the arm 58 to pivot about the apex of the bend 56 as indicated by arrow 70 in FIG. 6A.

The switching arrangement 60 in the embodiment of FIGS. 5-8 is provided by the two spring terminals 54 (including both terminal 52*a* and 52*b*) and a connection bridge 72 that extends between the two moveable arms 58 of the spring terminals 54. The connection bridge 72 may be provided in any of various forms, including a thin conductive plate, wire or trace that extends across an anterior portion of the housing 12 near the mouth of the device 10. The moveable arms 58 provide actuators for the switch arrangement and are moveable between (i) an open position where one or both of the arms 58 is disengaged from (i.e., not in contact with) the connection bridge 72 (as shown in FIG. 6B), and (ii) a closed position where both arms 58 engage (i.e., are in contact with) the connection bridge 72 (as shown in FIG. 6A).

Figure 6A:
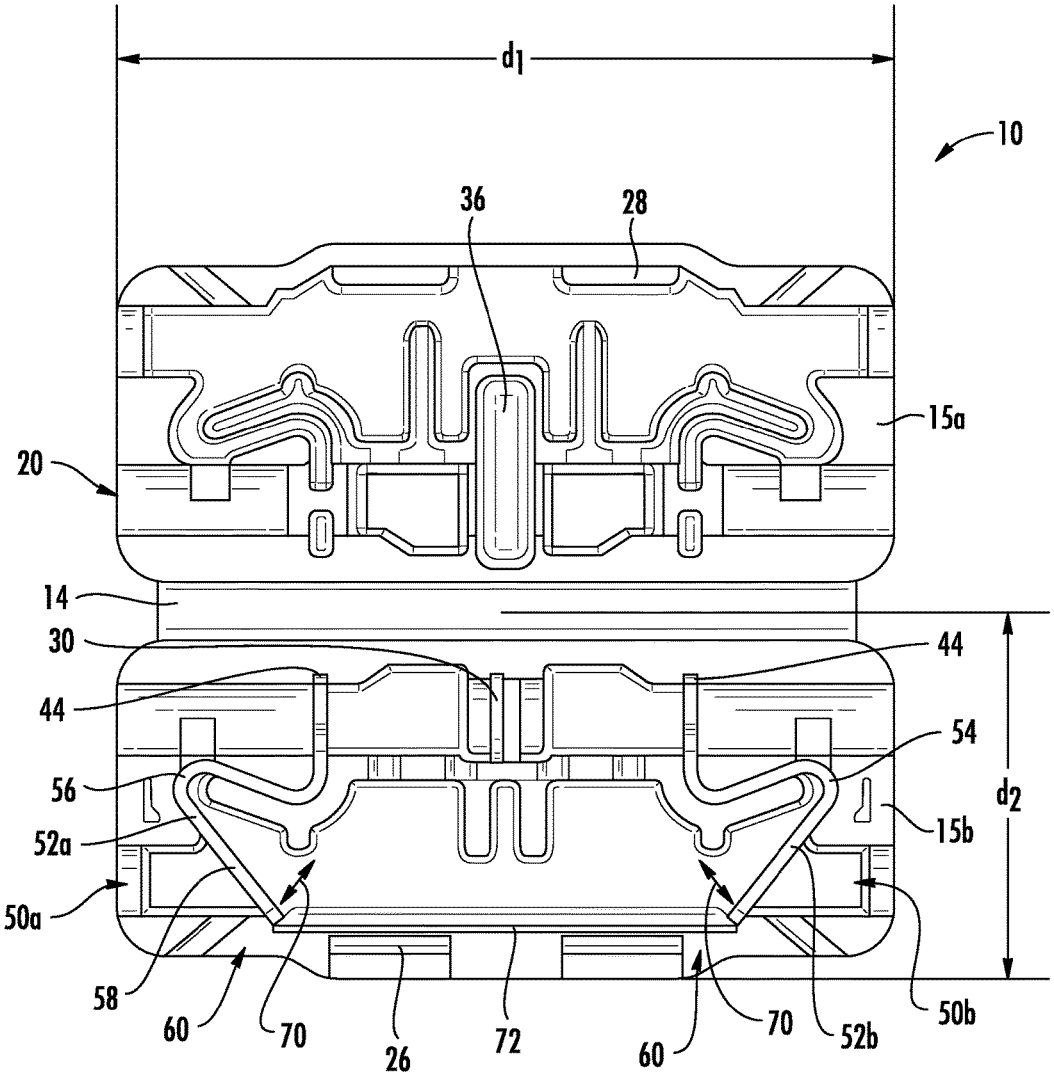
FIG. 6A is a top view of the wire cut and tap device of FIG. 5 with a switch arrangement in a closed position.
Figure 7:
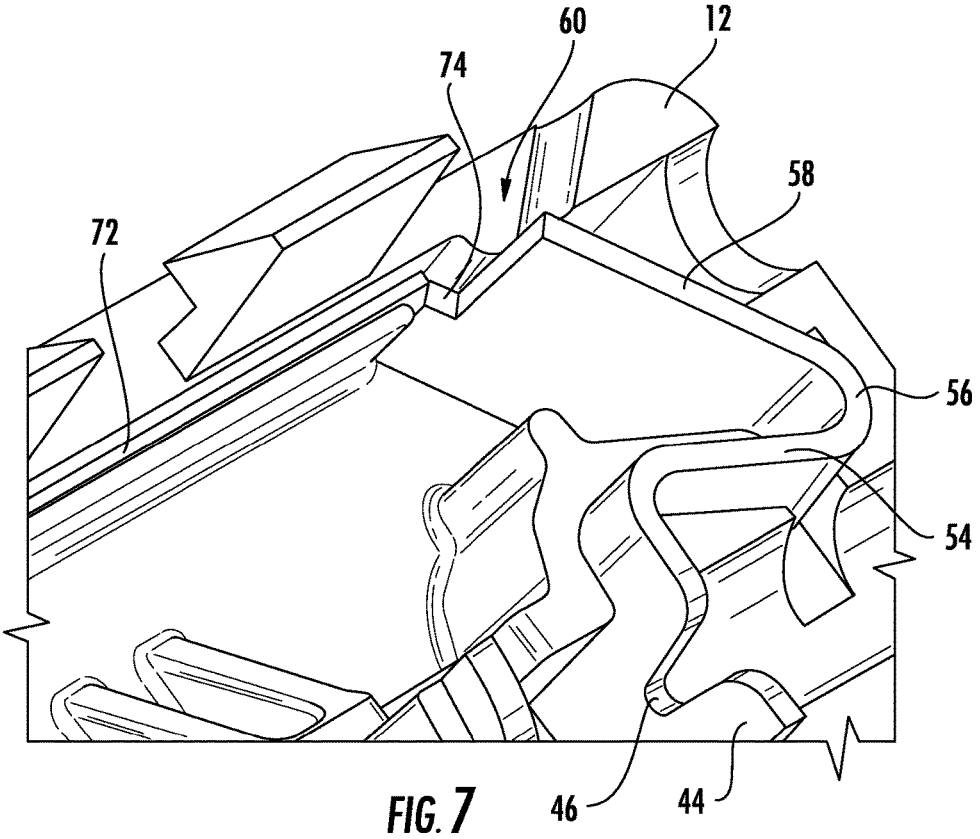
FIG. 7 is an enlarged perspective view of a contact for the wire cut and tap device of FIG. 5.

The spring terminals 54 are configured such that the moveable arms 58 are biased toward the closed position where they engage the connection bridge 72, as shown in FIG. 6A. The connection bridge 72 provides an electrically conductive pathway between the moveable arms 58 of the two spring terminals 54 when the switch arrangement 60 is in the closed position. As best shown in FIG. 7, each of the moveable arms 58 may include an extension portion 74 to facilitate solid contact between the moveable arm 58 and the bridge 72 when the switching arrangement 60 is in the closed position.

Figure 6B:
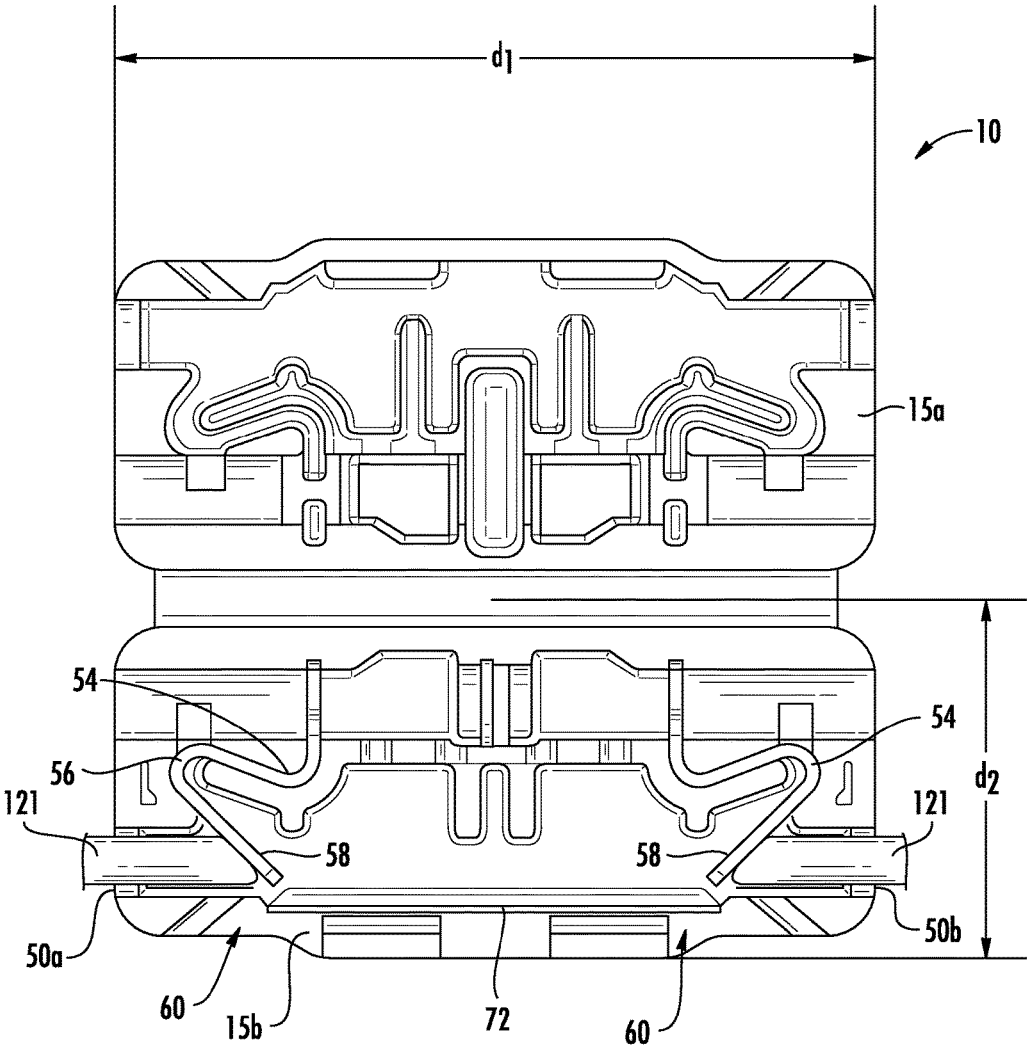
FIG. 6B is a top view of the wire cut and tap device of FIG. 6A with the switch arrangement in an open position.

As shown in FIG. 6B, the switching arrangement 60 is moved to the open position when one or more leads 121 are inserted into the slots 50 of the housing. When a lead 121 is inserted into one of the slots 50, the moveable arm 58 of the spring terminal 54 is compressed and moved out of engagement with the connection bridge 72. As a result, the terminal 52*a* is electrically isolated from the terminal 52*b*, and the switching arrangement is open. The lead 121 may be any appropriate lead, such as a male prong or even a wire end having sufficient rigidity to compress the spring arm 58 and move it out of engagement with the connection bridge 72.

The leads 121 may be used to easily connect or disconnect the circuit of an electronic accessory to or from a circuit including the wire extending through the device 10. In particular, when the leads from the electronic accessory are inserted into the slots 50, the switching arrangement 60 is opened and the electronic accessory may be inserted in series in the line provided by the wire extending through the device 10. When the electronic accessory is to be removed, the two leads from the electronic accessory are removed from the slots 50, and the switching arrangement is closed, returning the circuit to its original condition without the electronic accessory.

Figure 8:
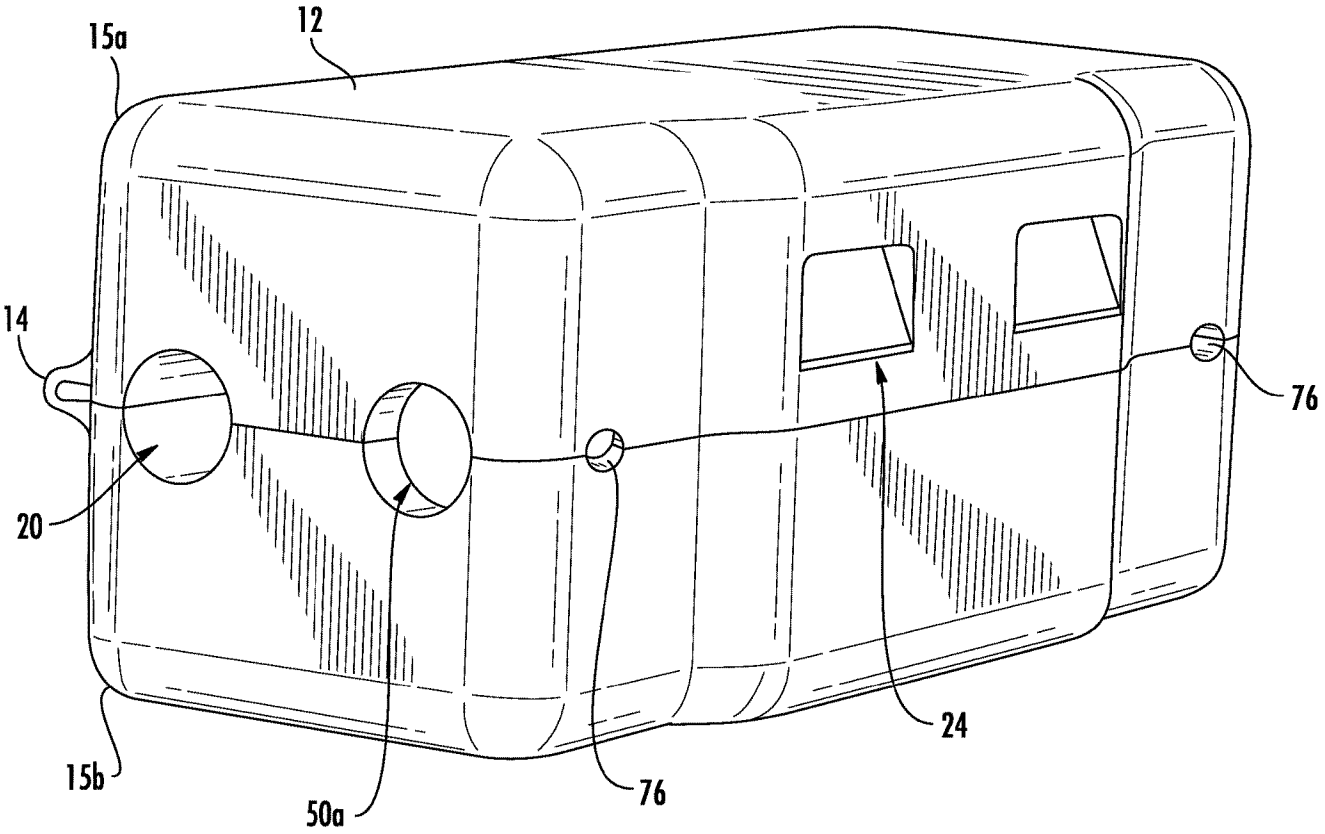
FIG. 8 is a perspective view of the wire cut and tap device of FIG. 5 in a closed position.

As shown in FIG. 8, in at least one embodiment, small access ports 76 are provided in the housing 12 in the vicinity of the spring terminals 54. These access ports allow a technician to compress the spring arms 58, if needed, by inserting the end of a paper clip (or other tool) through the access port 76. For example, the access ports may be useful if one of the leads 121 stick to the associated spring arm 58 in the slot 50 during a de-installation procedure. Once the lead is removed from the slot, the spring arm is relaxed, and the spring arm 58 makes contact with the connection bridge.

As discussed previously, the dimensions of the components of the device 10 may vary depending on the gauge of the wire for which the device 10 is intended. As shown in 6A, the housing 12 includes dimensions $d_1$ and $d_2$. In at least one embodiment $d_1$ may be between 0.75 inches and 1.5 inches, and particularly about 1 inch. In such embodiment, $d_2$ may be between 0.25 and 0.75 inches, and particularly about 0.5 inch.

Exemplary Application for Device in Automotive Aftermarket

Figure 9:
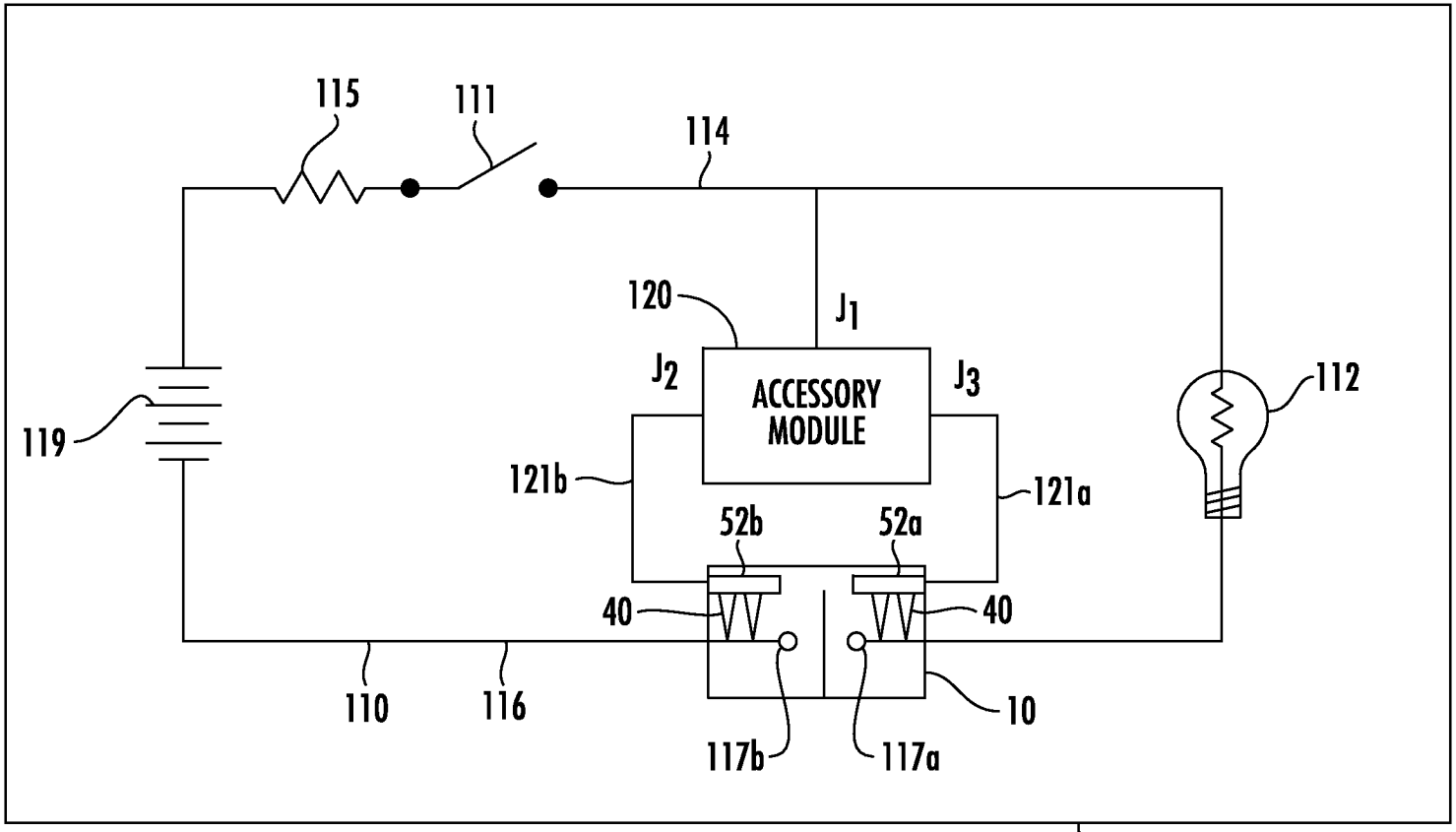
FIG. 9 is a high level schematic of a vehicle brake light circuit with a wire cut and tap device positioned in the brake light circuit in association with an electronics module configured to facilitate pulsation of the vehicle brake lights.

With reference now to FIG. 9, in at least one exemplary embodiment, the wire cut and tap device 10 is used in an automobile circuit to add an aftermarket accessory in the form of an electronic module to the automobile. In the particular exemplary embodiment of FIG. 9, the aftermarket accessory is a lighting control module 120 installed in a brake light circuit 110 of a vehicle 8. The lighting control module facilitates pulsing of the vehicle's brake lights when the operator applies the brake.

An exemplary lighting control module 120 is disclosed in U.S. patent application Ser. No. 14/301,078, filed Jun. 10, 2014, the contents of which are incorporated herein by reference in their entirety. In such embodiment, the lighting control module 120 is an adaptive shunt that also includes a connection to the supply line 114 of the brake light circuit 110. However, it will be recognized that the lighting control module 120 shown in FIG. 9 is but one exemplary application for the wire cut and tap device 10, and the device 10 may be used to install various other electronic modules in any of various circuits in different configurations.

With continued reference to the embodiment of FIG. 9, the wire cut and tap device 10 is clamped directly on to the return line 116 of the brake light circuit. As a result, the return line 116 by the cutting blade 30 and the severed portions of the return line 116 are insulated by the non-conductive material 32 on the side of the blade 30. The severed ends 117*a* and 117*b* of the wire providing the return line 116 are shown in FIG. 9 with the conductive protrusions 40 contacting the severed ends of the return line. As described previously, the protrusions 40 provide an electrical connection to the terminals 52*a* and 52*b*. Leads 121*a* (also shown as J3) and 121*b* (also shown as J2) are respectively connected to the terminals 52*a* and 52*b* and provide a connection to the lighting control module 120.

As shown in FIG. 9, a brake switch 111 is provided on the supply line 114 along with some vehicle load 115. When an operator of the vehicle 8 depresses the brake pedal, the brake switch 111 is closed, connecting the supply line 114 to the vehicle battery 119, thus providing a voltage on the supply 114 (which may also be referred to herein as the "brake detection line 114). This results in current flowing through the brake light circuit 110 and illumination of the brake light 112. The lighting control device is configured to effect pulsing of the brake light upon detection of a voltage on the brake detection line 114.

The wire cut and tap device 10 described herein may be used to quickly and easily install an electronic accessory such as the lighting control module 120 in the brake light circuitry of an automobile. The device 10 allows the installer to add the lighting control module to the vehicle without the need to cut and strip any existing wires in a wiring harness. Instead, the installer simply clamps the device 10 onto the appropriate wire and plugs the lighting control module into the device. After this simple installation, the user is provided with an aftermarket arrangement wherein the brake lights provide a pulsing feature, as described above with reference to FIG. 9.

Should the owner of the vehicle ever decide that the lighting control module 120 is not desirable, the lighting control module 120 may be easily removed from the brake light circuitry by simply adjusting the switching arrangement 60 on the wire cut and tap device 10. When the user transitions the switching arrangement 60 from the first position to the second position (i.e., from the "include additional circuitry" position to the "return to original connections" position), the lighting connections to the control module 120 are terminated, and the original connections on the vehicle brake light circuitry are reinstated. In this manner, a user incorporating an aftermarket module into a circuit using the wire cut and tap device 10 described herein may easily remove the added aftermarket module with little or no additional work.

While the wire cut and tap device 10 has been described herein as being used in association with an automotive brake light system, it will be recognized that the device 10 may also be used in any of various other wiring arrangements when installing any of various electronic accessories to an electrical circuit. Examples of other applications exist across various platforms and industries, including any of various other residential, commercial, industrial, automotive, or personal appliance applications. Exemplary applications include residential and commercial automation equipment, residential and commercial security equipment, lighting systems, appliances, etc. Moreover, it will be recognized that the foregoing detailed description of one or more exemplary embodiments of the wire cut and tap with bypass feature has been presented herein by way of example only and not limitation. It will be recognized that there are advantages to certain individual features and functions described herein that may be obtained without incorporating other features and functions described herein. Furthermore, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A device configured for installation on a wire, the device comprising:

a housing comprising a first portion and a second portion;

a first connector slot and a second connector slot provided in the housing;

a wire passage provided in the housing and configured to retain the wire;

a blade configured to extend through the wire passage and sever the wire when the wire is positioned in the wire passage;

a first electrically conductive member configured to extend into the wire passage and engage a first end of the severed wire, the first electrically conductive member unitary in construction from a first end to a second end, the first end of the first electrically conductive member positioned in the wire passage, and the second end of the first electrically conductive member moveably positioned in the first connector slot;

a second electrically conductive member configured to extend into the wire passage and engage a second end of the severed wire, the second electrically conductive member unitary in construction from a first end to a second end, the first end of the second electrically conductive member positioned in the wire passage, and the second end of the second electrically conductive member moveably positioned in the second connector slot; and a switch arrangement retained by the housing, wherein the first end of the severed wire is connected to the second end of the severed wire when the switch arrangement is in a closed position, and wherein the first end of the severed wire is disconnected from the second end of the severed wire when the switch arrangement is in an open position;

wherein the second end of the first electrically conductive member and the second end of the second electrically conductive member movably provide a manual actuator configured to move the switch arrangement between the open position and the closed position.

2. The device of claim 1 wherein the first portion and the second portion of the housing are connected in clamshell fashion.

3. The device of claim 1 further comprising a first lead connecting the switch arrangement to an aftermarket electronic accessory, and a second lead connecting the switch arrangement to the aftermarket electronic accessory.

4. The device of claim 3 wherein the wire is part of a vehicle brake light circuit and the aftermarket electronic accessory is a lighting control module.

5. The device of claim 1 wherein the second end of the first electrically conductive member includes a first moveable arm, wherein the second end of the second electrically conductive member includes a second moveable arm, and wherein the first moveable arm and the second moveable arm are respectively configured to releasably engage a first lead and a second lead of a circuit exterior from the housing.

6. The device of claim 5 wherein the switch arrangement is open when the first lead is coupled to the first moveable arm or the second lead is coupled to the second moveable arm, and the switch arrangement is closed when the first lead and the second lead are de-coupled from the first moveable arm and the second moveable arm.

7. The device of claim 6 wherein the first moveable arm is a first spring arm configured to engage an electrical short path through the circuit exterior from the housing when the first lead deflects the first spring arm from a biased position abutting a bridge extending between the second of the first electrically conductive member and the second end of the second electrically conductive member, wherein the first moveable arm is configured to disengage the electrical short path when the first lead is de-coupled from the first spring arm and the first spring arm is in the biased position abutting the bridge.

8. The device of claim 5 wherein the first connector slot is arranged in the second portion of the housing, and the second connector slot is also arranged in the second portion of the housing.

9. The device of claim 8 wherein the connector slot and the second connector slot are provided on opposite sides of the housing such that the first lead inserted into the first connector slot is inserted in a first direction that is opposite a second direction in which the second lead is inserted into the second connector slot.

10. The device of claim 8 wherein the first conductor slot and the second conductor slot are provided on a same side of the housing such that the first lead inserted into the first conductor slot is inserted in a first direction that is parallel to a second direction in which the second lead is inserted into the second connector slot.

11. A device configured for installation on a wire, the device comprising:

a housing defining a first connector slot and a second connector slot;

a wire passage provided in the housing;

a blade positioned in the housing and configured to extend substantially through the wire passage, the blade dividing the wire passage into a first portion and a second portion;

a first electrically conductive member positioned in the housing and extending from the first portion of the wire passage to the first connector slot;

a second electrically conductive member positioned in the housing and extending from the second portion of the wire passage to the second connector slot;

a bridge member extending between the first electrically conductive member in the first connector slot and the second electrically conductive member in the second connector slot, the bridge member recessed in the first connector slot inwardly from the first electrically conductive member such that lead inserted in the first connector slot will engage the first electrically conductive member without engaging the bridge;

a switch arrangement retained by the housing, the switch arrangement including an electrical pathway extending between the first electrically conductive member in the first connector slot and the second electrically conductive member in the second connector slot with the bridge member extending therebetween, the switch arrangement moveable between a closed position and an open position, wherein the electrical pathway is closed when the switch arrangement is in the closed position, and wherein the electrical pathway is open when the switch arrangement is in the open position; and a manual actuator configured to move the switch arrangement from the closed position to the open position when a lead is inserted into the first connector slot without engaging the bridge.

12. The device of claim 11 wherein the manual actuator is moveable between a first position and a second position, wherein the switch arrangement in the open position when the actuator is moved to the first position, and wherein the switch arrangement is in the closed position when the manual actuator is moved to the second position.

13. The device of claim 11 wherein the the manual actuator is provided by a moveable arm of the first electrically conductive member, wherein insertion of a lead into the first connector slot urges movement of the moveable arm such that the switch arrangement moves from the closed position to the open position.

14. The device of claim 11 wherein first electrically conductive member is unitary in construction.

15. The device of claim 11 wherein the manual actuator is included within the electrical pathway.

16. The device of claim 15 wherein the manual actuator is a spring arm on the first electrically conductive member.

17. The device of claim 16 wherein the first connector slot is configured to receive a lead, and wherein the spring arm extends into the first connector slot.

18. The device of claim 17 wherein the first connector slot is configured to receive a prong of the lead and the lead is connected to an electronic module without the prong engaging the bridge.

19. A method of coupling an electronic module to an existing circuit, the method comprising:

coupling a housing with a switching arrangement to a wire of the existing circuit, the switching arrangement including a manual actuator;

severing the wire into a first end positioned within the housing and a second end positioned within the housing, the first end connected to a first terminal retained by the housing and the second end connected to a second terminal retained by the housing with an electrical pathway extending between the first terminal and the second terminal via an electrically conductive bridge extending between the first terminal and the second terminal within the housing; and connecting leads of the electronic module to the first terminal and the second terminal without contacting the electrically conductive bridge, the electronic module separate from the housing, wherein connecting the leads of the electronic module to the first terminal and the second terminal moves the manual actuator of the switching arrangement from a first position to a second position such that the electrical pathway is opened between the first terminal and the second terminal.

20. The method of claim 19 wherein connecting the leads of the electronic module to the first terminal and the second terminal moves the first terminal and the second terminal out of contact with the electrically conductive bridge.

* * * * *